US005546268A

United States Patent [19]

Hurley et al.

[11] Patent Number: 5,546,268

[45] Date of Patent: Aug. 13, 1996

[54] ELECTROMAGNETIC DEVICE WITH CURRENT REGULATED CLOSURE CHARACTERISTIC

[75] Inventors: Rick A. Hurley, Fletcher; Mark E. Innes; Nelson R. Palmer, both of Asheville, all of N.C.

[73] Assignee: Eaton Corporation, Cleveland, Ohio

[21] Appl. No.: 281,953

[22] Filed: Jul. 28, 1994

[51] Int. Cl.[6] ..... H01H 47/04

[52] U.S. Cl. ..... 361/154; 361/160

[58] Field of Search ..... 361/154, 160, 361/2, 187; 307/137; 324/418, 420, 422, 423

[56] References Cited

U.S. PATENT DOCUMENTS

| | | | |
|---|---|---|---|
| 4,511,945 | 4/1985 | Nielsen | 361/154 |
| 4,679,116 | 7/1987 | Oshizawa et al. | 361/154 |
| 4,720,763 | 1/1988 | Bauer | 361/154 |
| 4,833,565 | 5/1989 | Bauer et al. | 361/154 |
| 4,893,102 | 1/1990 | Bauer | 335/132 |
| 5,128,825 | 7/1992 | Hurley et al. | 361/154 |
| 5,270,898 | 12/1993 | Elms et al. | 361/96 |
| 5,315,471 | 5/1994 | Hurley et al. | 361/160 |

FOREIGN PATENT DOCUMENTS 2601799 7/1977 Germany .

*Primary Examiner*—Fritz M. Fleming

*Attorney, Agent, or Firm*—Martin J. Moran

[57] ABSTRACT

An electromagnetic switch includes separable contacts, an electromagnet having a coil which is energized to close and hold closed the separable contacts, a power supply for applying current to the coil, and a closed-loop control circuit for sensing and regulating, throughout a contact closure cycle, the current applied to the coil to a selected current reference. The current reference may include a closing current reference for closing the contacts and a holding current reference for holding the contacts closed. The control circuit may include a microcomputer for generating the current reference and, further, may include a first switching circuit and an associated control circuit for actuating the first switching circuit between enabled and inhibited states, a second switching circuit and an associated control circuit for actuating the second switching circuit between conductive and non-conductive states, a feedback circuit for sensing the coil current and generating a related feedback signal, and a comparator circuit for comparing the current reference and the feedback signal, and for inhibiting the second switching circuit whenever the feedback signal is greater than the current reference. The microcomputer may include control signals defining states corresponding to a predetermined closing current reference and a predetermined holding current reference. One of the control signals may attenuate the feedback signal, in order to provide the closing current reference. The electromagnetic switch may alternatively include a circuit for generating a time-variable current reference in order to substantially follow a predetermined magnet pull curve of the electromagnet.

18 Claims, 12 Drawing Sheets

ELECTROMAGNETIC DEVICE WITH CURRENT REGULATED CLOSURE CHARACTERISTIC

BACKGROUND OF THE INVENTION

1. Field of the Invention

This invention relates to closure of electromagnetic devices and more particularly to closure of electromagnetic contactors in which electrical contacts are closed and held closed by controlling application of current to a coil of an electromagnet.

2. Background of Information

Electromagnetic contactors are electrically operated switches used for controlling motors and other types of electrical loads. Contactors include a set of movable electrical contacts which are brought into contact with a set of fixed contacts to close the contactor. The contacts are biased open by a kickout spring. A second spring, called a contact spring, begins to compress as the moving contacts first touch the fixed contacts. The contact spring determines the amount of current that can be carried by the contactor and the amount of contact wear that can be tolerated. The movable contacts are carried by an armature of an electromagnet. Energization of the electromagnet overcomes the spring forces and closes the contacts.

In earlier contactors, the energy applied to a coil of the electromagnet was substantially in excess of that required to effect closure. While it is desirable to have a positive closing to preclude welding of the contacts, the excess energy is unnecessary and even harmful. If the armature of the electromagnet seats while traveling at a high velocity, the excess kinetic energy is absorbed by the mechanical system as shock, noise, heat, vibration and contact bounce.

One type of electromagnetic contactor is disclosed in U.S. Pat. No. 4,893,102. This system reduces contact bounce which may occur when the respective contacts of the electromagnetic contactor impact each other during an actuation cycle. This is achieved by controlling energization of the contactor coil in four separate stages: (1) an acceleration stage; (2) a coast stage; (3) a grab stage; and (4) a hold stage. When at rest, the contacts are held in a normally open position by the force of the kickout spring disposed within the contactor assembly. In the acceleration stage, the contactor coil is fully energized and the contacts are accelerated toward a closed position at a maximum rate. In the coast stage, the contact mechanism has already achieved enough velocity to achieve closure, so energization of the contactor coil is reduced or eliminated entirely to reduce the force of contact closure impact to a minimum level. In the grab stage, the system evaluates a closing velocity of the contactor mechanism and adjusts energization of the contactor coil to ensure the contactor mechanism has enough momentum to guarantee contact closure. Finally, in the hold stage, energization of the contactor coil is reduced to a level sufficient to counteract the force of the kickout spring and maintain the contacts in a closed position.

U.S. Pat. No. 5,128,825 is directed to an electromagnetic contactor which accommodates to dynamic conditions of the contactor coil and supply voltage to provide consistent closure characteristics of low impact velocity and reduced contact bounce of about 6 ms. The contactor gates a first voltage pulse to the coil of the contactor electromagnet at a fixed, preferably full, conduction angle, and monitors the electrical response of the coil, namely the peak current. The conduction angle of the second pulse is then adjusted based upon the peak current produced by the first voltage pulse and the voltage of the first pulse to provide, together with the first voltage pulse, a constant amount of electrical energy to the coil despite variations in coil resistance and supply voltage. The third and subsequent voltage pulses to the coil of the contactor are gated at conduction angles preselected in order that, with constant energy supplied by the first and second voltage pulses, the contacts touch and then seal at a substantially constant point in a selected pulse. Contact closure can occur at the third pulse, or in a large contactor where more energy is required, at a later pulse. Contact touch and sealing consistently occur on declining coil current in order to achieve low impact velocity and reduced contact bounce.

Normally, the third and subsequent pulses are gated to the contactor coil at constant, preselected conduction angles. However, under marginal conditions for closure where the peak current produced by the first voltage pulse is below a predetermined value, a second set of conduction angles is used to gate the third and subsequent voltage pulses to the coil. This second set of conduction angles produces a substantially full conduction of the third and subsequent pulses.

While the microcomputer controlled contactor of U.S. Pat. No. 5,128,825 is a great improvement over earlier contactors, and goes a long way toward providing positive closure with reduced contact bounce by accounting for dynamic changes in the characteristics of the contactor electromagnet, there is room for improvement. Although the volt-amps (VA) required for closure is premeasured and a recipe is predetermined for closing the contactor with low bounce, several limitations include: (1) the recipe is not calculated during operation and, thus, is stored in the limited non-volatile memory of the microcomputer; (2) the recipe covers a wide VA range and, therefore, is not optimized for the very low or the very high ends of the VA range; (3) the recipe provides control without feedback and, hence, abrupt changes in the line voltage and line frequency are not included in the closure control algorithm; and (4) stored recipes require significant digital logic and, thus, additional cost to implement.

There is a need, therefore, for an improved contactor which provides a consistent closing time and a consistent armature closing velocity with minimum contact bounce.

There is a further need for such a contactor which consistently reduces armature closing velocity and, thus, contact bounce time.

There is an additional need for such a contactor which takes into account dynamic changes in line frequency and line voltage.

There is a more particular need for such a contactor which generally operates independently of the line frequency and voltage.

SUMMARY OF THE INVENTION

These and other needs are satisfied by the invention which is directed to an electromagnetic contactor having an electromagnet coil and a closed-loop current regulator which accommodates to dynamic conditions of the line voltage, the line frequency and the coil impedance in order to provide a consistent armature closing time and closing velocity with minimum contact bounce. The contactor in accordance with the invention uses field effect transistors (FET's) to gate current to the coil, a feedback resistor to sense current in the coil, and a feedback comparator having a current reference signal. The current feedback is adjusted in order that the current reference signal is selected from a first closing current reference during contact closure and a second holding current reference after closure. A microcomputer generates these current references as a function of time thereby providing a consistent contactor closing time and closing velocity. In this manner, the coil current is regulated, throughout the contact closure cycle, to a selected current reference to close the separable contacts and to hold the separable contacts closed.

Alternatively, a control circuit generates a time-variable current reference which substantially follows a predetermined magnet pull curve of the electromagnet coil. The predetermined magnet pull curve has an initial closing current at a start of the contact closure cycle, an intermediate closing current which is smaller than the initial closing current, progressively smaller currents between the initial closing current and the intermediate closing current, a final closing current which is larger than the initial closing current, a holding current which is smaller than the intermediate closing current, and progressively smaller currents between the final closing current and the holding current. The control circuit generates the current reference which corresponds to the initial closing current, generates progressively smaller currents between the initial closing current and an intermediate closing current, generates the final closing current which is larger than the initial closing current, and generates progressively smaller currents between the final closing current and the holding current. The final closing current is generated at about the time of closing the separable contacts.

It is an object of the invention to provide an improved contactor which uses closed-loop current control throughout a contact closing and holding cycle in order to provide the appropriate energy required for consistent closing time and closing velocity with minimum contact bounce.

It is another object of the invention to provide an improved contactor having a control circuit for making current reference adjustments within the very short time frame of the contact closure cycle.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
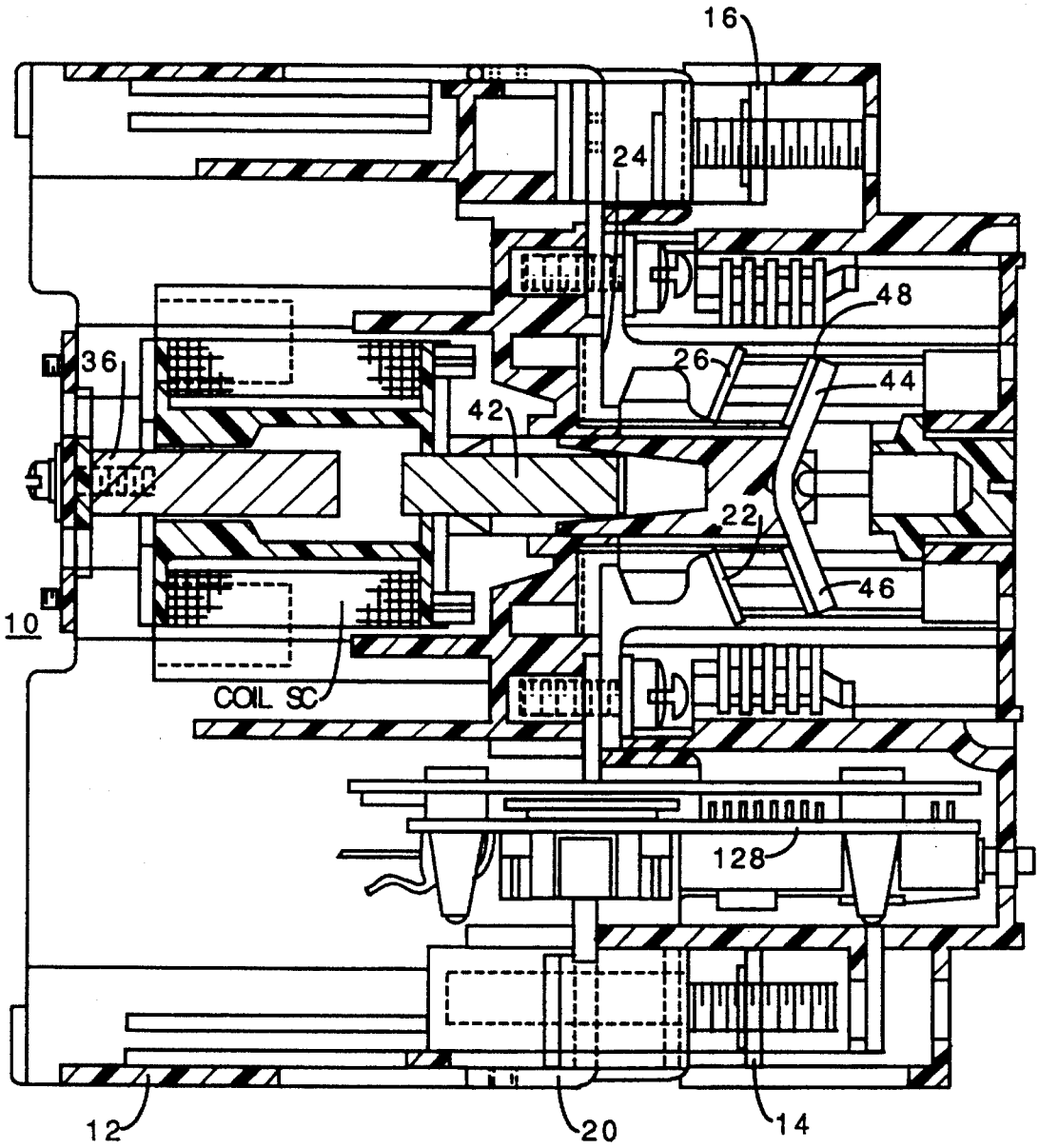
FIG. 1 PRIOR ART
FIG. 1 is a vertical sectional view showing a spatial relationship of a contactor coil and contacts in a typical three-phase contactor system incorporating the subject invention.

Referring to FIG. 1, a contactor or motor starter 10 has an insulated housing 12. A complete description of an electromagnetic contactor is disclosed in U.S. Pat. No. 4,893,102 issued Jan. 9, 1990 and U.S. Pat. No. 5,315,471, issued May 24, 1994, which are herein incorporated by reference. A pair of spaced apart terminals 14,16 for each phase (only one phase is shown) are provided for connecting an electrical load, such as a motor winding which is to be controlled by the contactor 10, to a power source. Terminal 14 is interconnected with an internal conductor 20 leading to a fixed contact 22 while terminal 16 is interconnected with an internal conductor 24 connected to a fixed contact 26. A contact carrier or armature 42 supports an electrically conductive contact bridge 44 having movable contacts 46,48 at opposite ends which are complementary with the fixed contacts 22,26, respectively.

Movement of the armature 42 and, therefore, the contact bridge 44 and movable contacts 46,48 is effected by a magnet 36 having a coil SC. The coil SC is, in turn, controlled by a circuit board 128 to be described in detail below. The armature 42 is spring biased to the position shown in FIG. 1 in which the contact pairs 22,46 and 26,48 are opened to interrupt the circuit between terminals 14 and 16. When the coil SC is energized, the armature 42 is pulled down against the magnet 36 in order to close the contact pairs 22,46 and 26,48. Therefore, the circuit is completed to energize the load, such as a motor winding connected to the contactor 10.

Figure 2A:
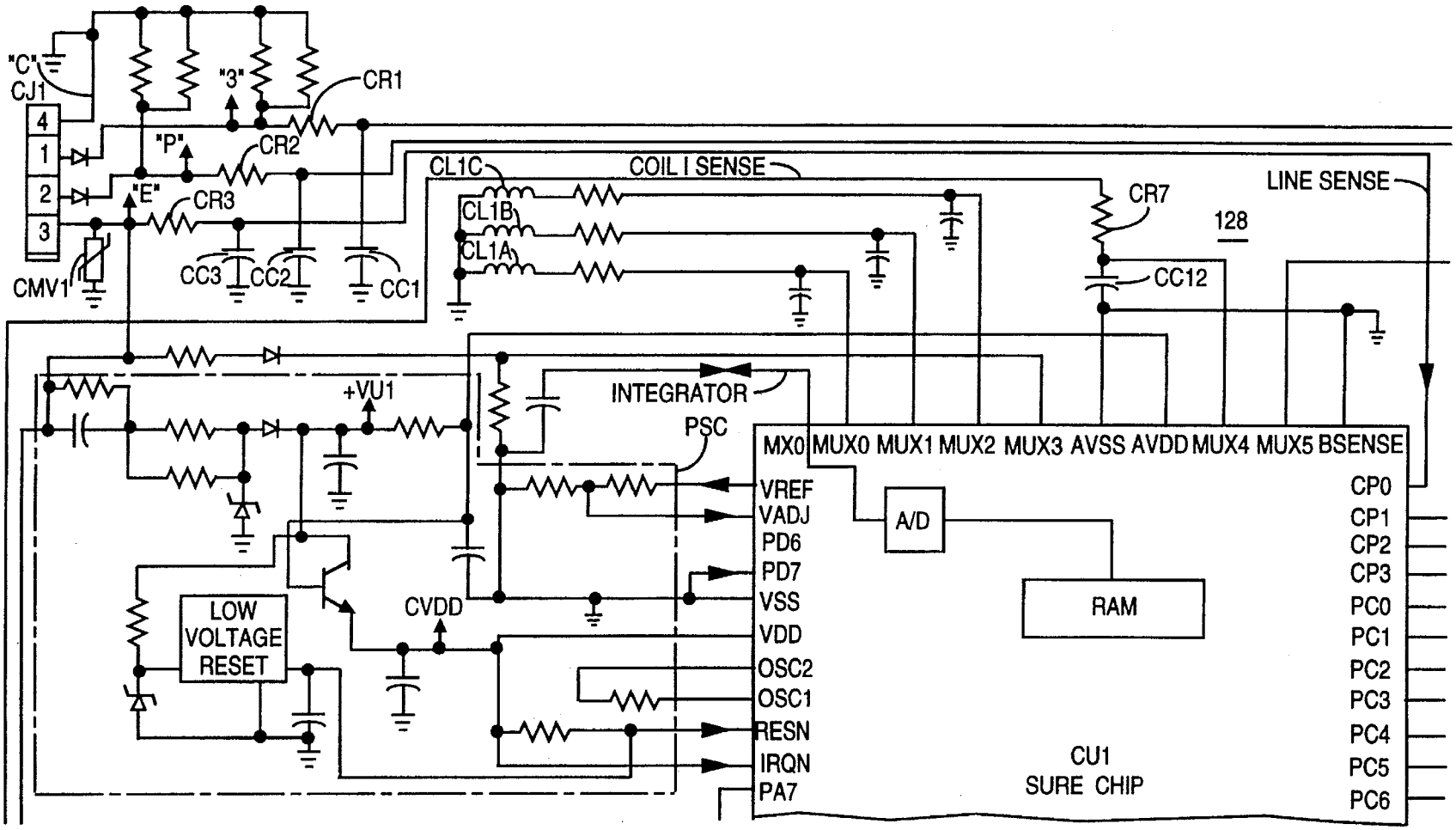
FIG. 2A PRIOR ART
FIGS. 2A–2C are a schematic circuit diagram and partial block diagram of a microcomputer-based control system for generating current references and controlling contactor coil current in accordance with the invention.
Figure 2B:
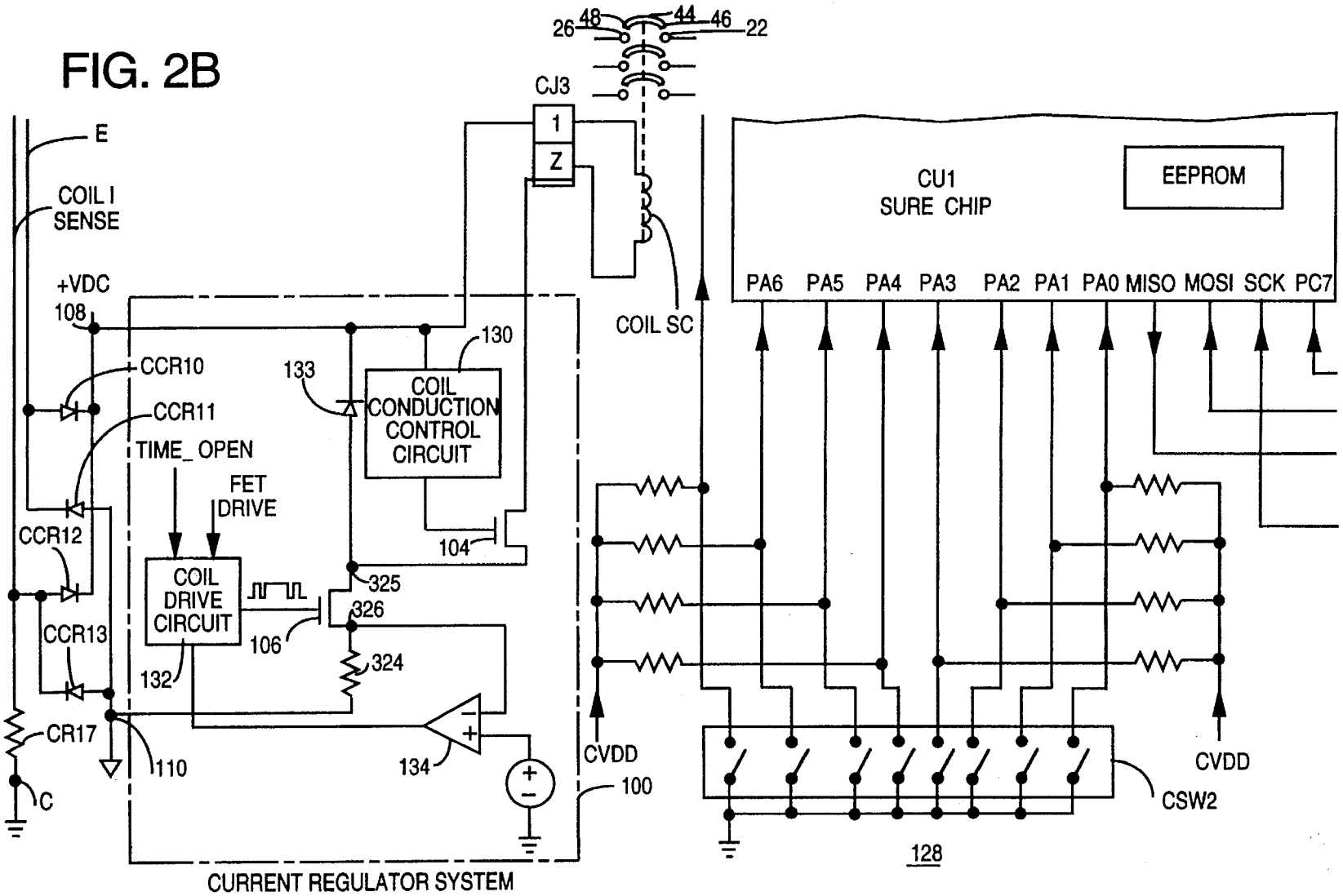
Figure 2C:
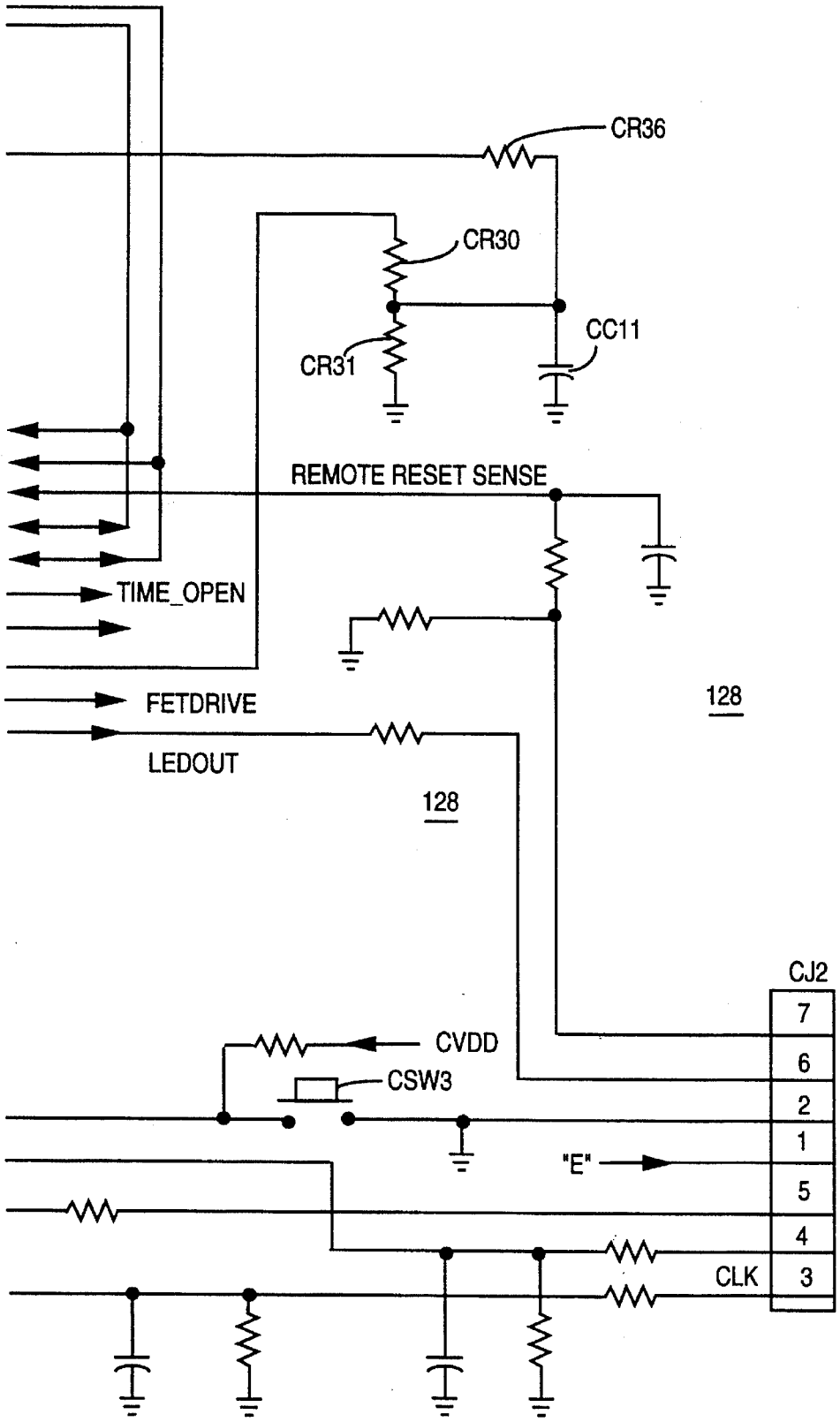
FIG. 2C PRIOR ART

FIGS. 2A–2C together illustrate a schematic circuit diagram and partial block diagram for the control board 128 which generates current references and controls operation of coil SC. The heart of the control circuit 128 is a microprocessor provided on the integrated circuit chip CU1. A suitable microprocessor chip CU1 is the "sure chip plus" which is disclosed in more detail in U.S. Pat. No. 5,270,898, issued Dec. 14, 1993, which is herein incorporated by reference. The chip CU1 includes a multiplexer, a processor, an EEPROM memory, and analog and digital input and output interfaces. The pins of CU1, shown in FIGS. 2A–2B herein, are disclosed in greater detail in FIG. 82 and column 114, line 46 through column 117, line 46 of U.S. Pat. No. 5,270,898. Pin VDD of CU1 is connected to voltage CVDD. The EEPROM, A/D and RAM sub-systems of CU1 are disclosed in greater detail in column 8, line 13 through column 11, line 22 of U.S. Pat. No. 5,270,898.

Referring to FIG. 2A, four input terminals labeled 1–4, are provided on an input connector CJ1. Terminal 4 is connected to system common or ground and is designated the "C" input. Terminal 1 of the connector CJ1 inputs a start signal which is identified as "3" and is applied to the chip CU1 to start the motor. Terminal 2 of the connector CJ1 provides a permit signal "P" which must be present in order for the motor to run. Terminal 3 of the connector CJ1 receives the 120 volt line voltage which is designated as the signal "E". This line voltage signal "E" provides power for operation of the microprocessor CU1 and for energization of the contactor coil SC. The signals "3", "P" and "E" are respectively passed through low pass filters formed by the resistors CR1–CR3 and capacitors CC1–CC3 before being applied to the chip CU1. A varistor CMV1 protects the control board 128 from surges in the line voltage signal "E".

A power supply circuit PSC, which is fed by the line voltage signal "E", provides regulated voltages for the chip CU1. Current transformers CL1A,CL1B, CL1C monitor the three-phase load current for input to the chip CU1 through multiplexer inputs MUX0,MUX1,MUX2, respectively. The system voltage as represented by the "E" signal is input through multiplexer input MUX3.

Referring now to FIG. 2B, the line voltage signal "E" is rectified by the bridge circuit formed by the diodes CCR10–CCR13 to generate a pulsating DC voltage+VDC at terminal 108 for energizing the contactor coil SC. An optional filter (not shown) may filter the+VDC voltage between DC power terminal 108 and DC ground terminal 110. A current regulator system 100 induces current flow in the contactor coil SC via the switching action of transistors 104, 106. Specifically, when each of transistors 104,106 are forward biased or "turned-on", current flows from the DC power terminal 108, through coil SC, transistors 104, 106 and feedback resistor 324, to DC ground terminal 110. When current flows through contactor coil SC, the resulting magnetic field moves armature 42 (see FIG. 1), thereby closing contact pairs 22,46 and 26,48.

The level of current flow through contactor coil SC is controlled by the duty cycle of transistor 106 which is regulated by contactor coil drive circuit 132. Contactor coil conduction control circuit 130 provides for biasing of transistor 104 during the time that the coil SC is energized and the contactor is closed and, also, provides for a rapid turn-off of transistor 104 whenever the contactor is opened. Contactor coil drive circuit 132 generates a pulse-width modulated switching signal used for activating contactor coil SC. In addition, contactor coil drive circuit 132 regulates a level of current flowing in the transistors 104,106 during contactor coil conduction cycles via the pulse-width modulated switching signal. Fly-back diode 133 provides a path for current flow through contactor coil SC and transistor 104 during positive transitions of the pulse-width modulated switching signal which occur during contactor coil conduction cycles. A coil current sense signal COIL I SENSE is filtered by a low pass filter of FIG. 2A formed by resistor CR7 and capacitor CC12 before being input to the chip CU1. Current regulation is provided through feedback comparator 134 which senses the current flowing through contactor coil SC during contactor coil conduction cycles and generates an error signal for adjusting the duty cycle of the pulse-width modulated signal generated by contactor coil drive circuit 132.

Contactor coil drive circuit 132 also responds to two control signals designated TIME_OPEN and FETDRIVE which are generated by processor CU1 (see FIGS. 2A and 2C). The specific function of the TIME_OPEN and FETDRIVE signals is discussed in detail below with FIGS. 4B and 4C. Briefly however, upon receiving a start signal and a permit signal, processor CU1 simultaneously generates the TIME_OPEN and FETDRIVE control signals to energize the contactor coil SC with a predetermined closing current. Then, after a predetermined time interval, the FETDRIVE signal is reset, in order to continue to energize contactor coil SC with a predetermined holding current. The coil current is regulated throughout the entire contact closure cycle. Upon removal of the permit signal, processor CU1 resets the TIME_OPEN signal to cancel the pulse-width modulated switching signal, thereby deactivating contactor coil SC.

The contactor 10 provides overload protection for the load, such as a motor, connected to the contactor. Dip switch CSW2 has eight switches of which five switches are used to select the rated current for the motor being controlled through the inputs PA0–PA4 of the chip CU1. The other three switches of dip switch CSW2 are provided to select two trip delays through inputs PA5 and PA6, and a manual/automatic thermal reset through input PA7.

Turning to FIG. 2C, an external capacitor CC11 stores a motor heat profile characteristic value generated by the chip CU1. This value is applied to the capacitor CC11 through a port PC4 and a resistor CR30. The value of the heat profile characteristic stored in the capacitor CC11 decays by discharge through a resistor CR31 at a rate which mimics the cooling of a motor controlled by the contactor 10 when power has been removed from the circuit board 128. The charge stored on the capacitor CC11 is read by the chip CU1 through the multiplexer input MUX5 which is connected to the capacitor CC11 through a resistor CR36.

The contactor 10 can be reset remotely by a signal received through a connector CJ2 and applied to the chip CU1 as a REMOTE RESET SENSE signal. The chip CU1 also generates an LEDOUT signal through the connector CJ2 for energization of an LED on a remote console for indicating the operating mode of the contactor. The contactor 10 can also be reset locally by activation of the switch CSW3. The microprocessor based contactor can communicate with, and be controlled by, a remote station through a serial data input port SDI and a serial data output port SDO synchronized by a clock signal which is input through port SCK. The remote clock signal and the serial data input and output signals are connected to the remote system through terminals on the connector CJ2.

Figure 3:
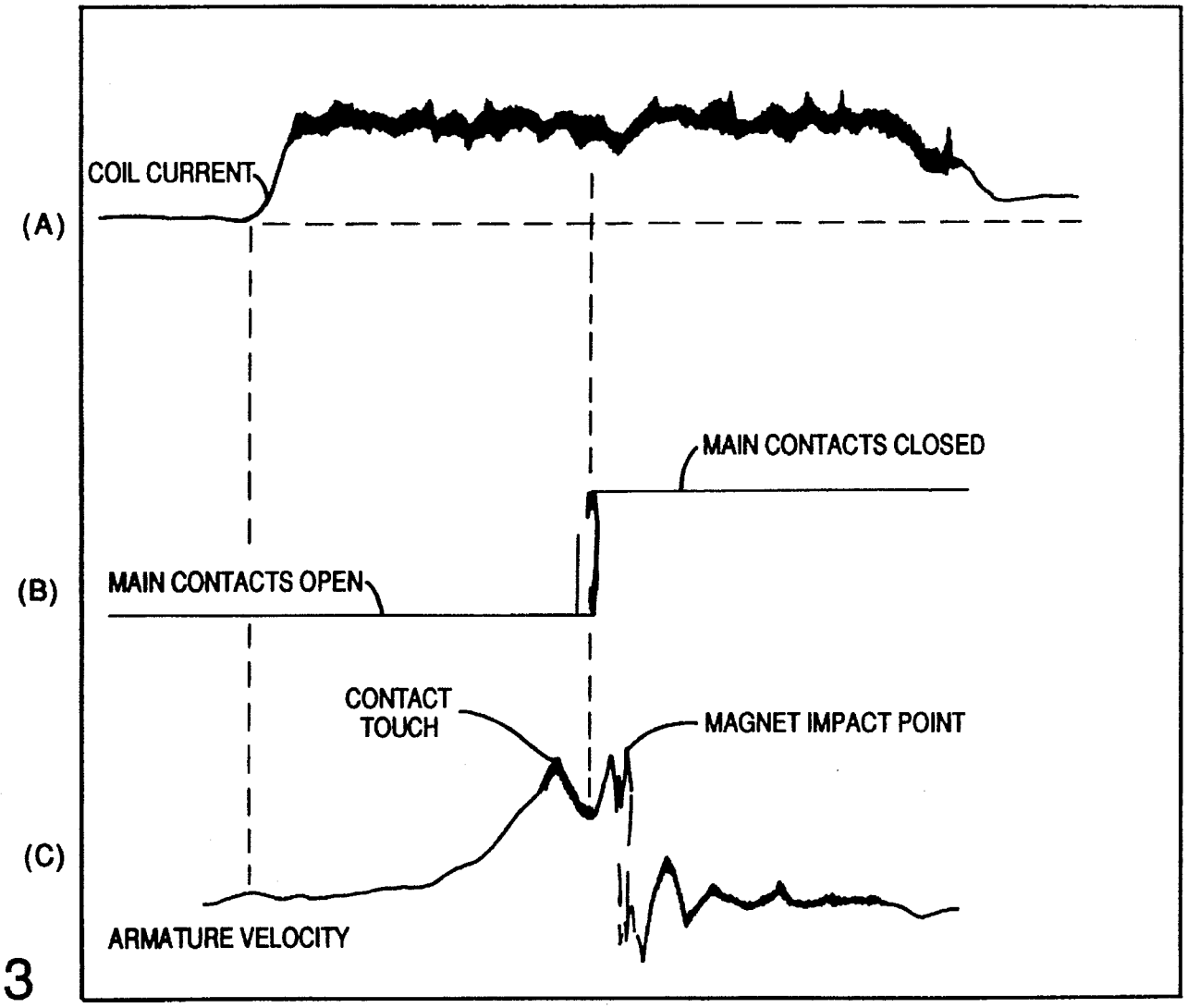
FIG. 3 illustrates a coil current waveform, main contact position and armature velocity for a contactor operated in accordance with the invention.

FIG. 3 illustrates: (A) a coil current waveform; (B) main contact position; and (C) armature velocity, respectively, for the exemplary embodiment of FIGS. 1 and 2B. The force required to close an electromagnetic device (e.g., magnet 36 having coil SC) is proportional to ampere-turns in the coil of the device. Thus, knowing the number of turns in the coil, coil current can be regulated in order to provide a known closing force. Furthermore, knowing the closing force, an accurate value for the closing time may be predetermined using empirical data.

In particular, whenever contactor 10 closes contacts 22,46 and 26,48, the current in coil SC is regulated from an initial zero amperes to a fixed closing current reference of approximately 12 A. This value of closing current overcomes the friction, inertia and spring forces of the mechanical system of contactor 10; provides a substantially constant armature closing velocity at closure, in order to prevent the contacts 22,26,46, 48 from reopening; and ensures that the armature 42 does not stall at the touch point but continues through with sufficient velocity to ensure a magnet-armature seal position without undue shock and contact bounce. In this manner, contact bounce time is reduced from a prior art time of 6 ms to about 2 ms. Furthermore, the peak armature velocity at closing is relatively independent of power line voltage and power line frequency. After the unit is closed, the coil current is reduced from the closing current reference to a holding current reference of approximately 1 A. Because the magnet-armature gap is small in the seal position, the coil current is reduced to, and is held constant at the holding current value, in order to maintain the closed position of armature 42.

Figure 4A:
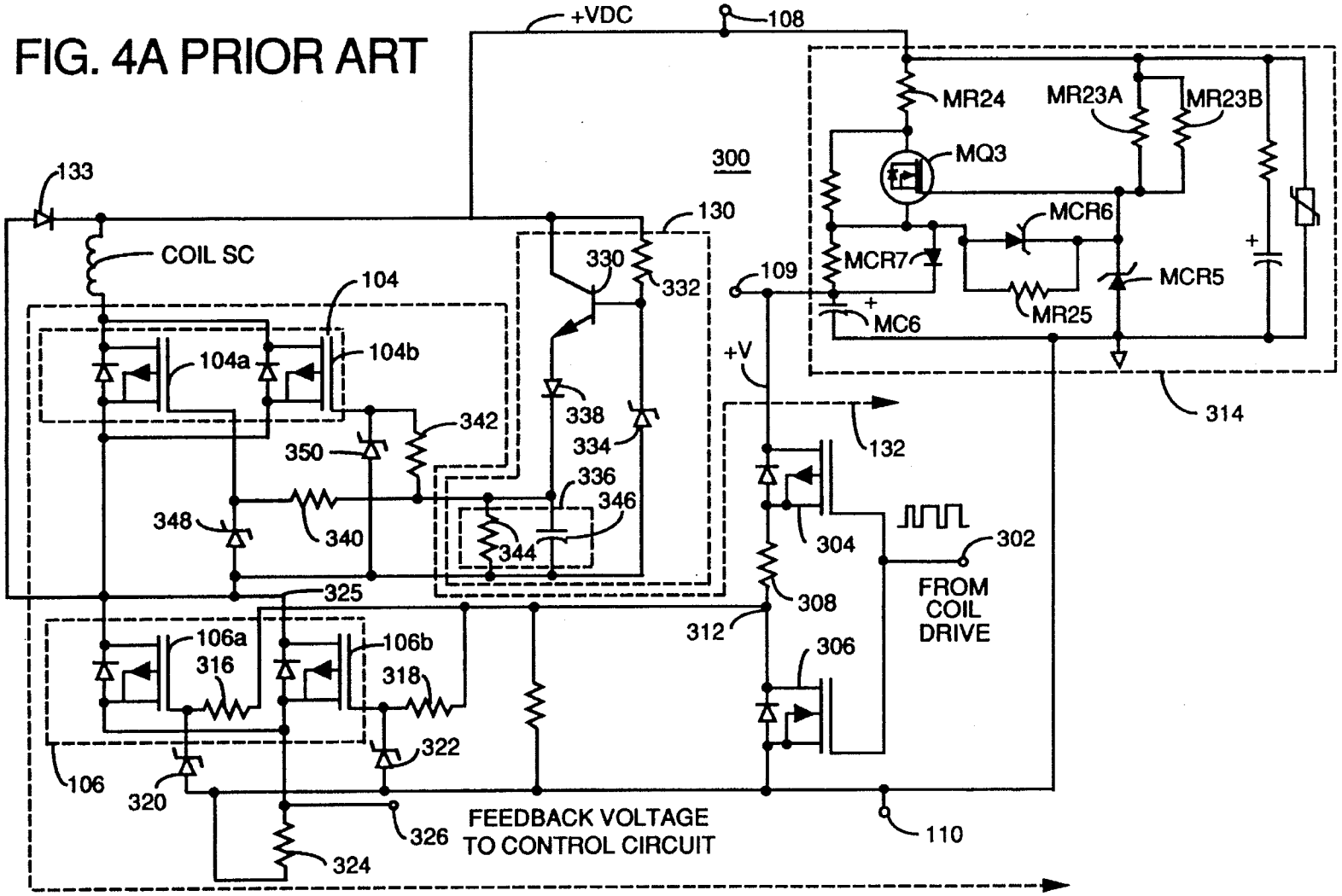
FIG. 4A PRIOR ART
FIG. 4A is a schematic diagram of a contactor coil switching arrangement in accordance with the present invention.
Figure 4B:
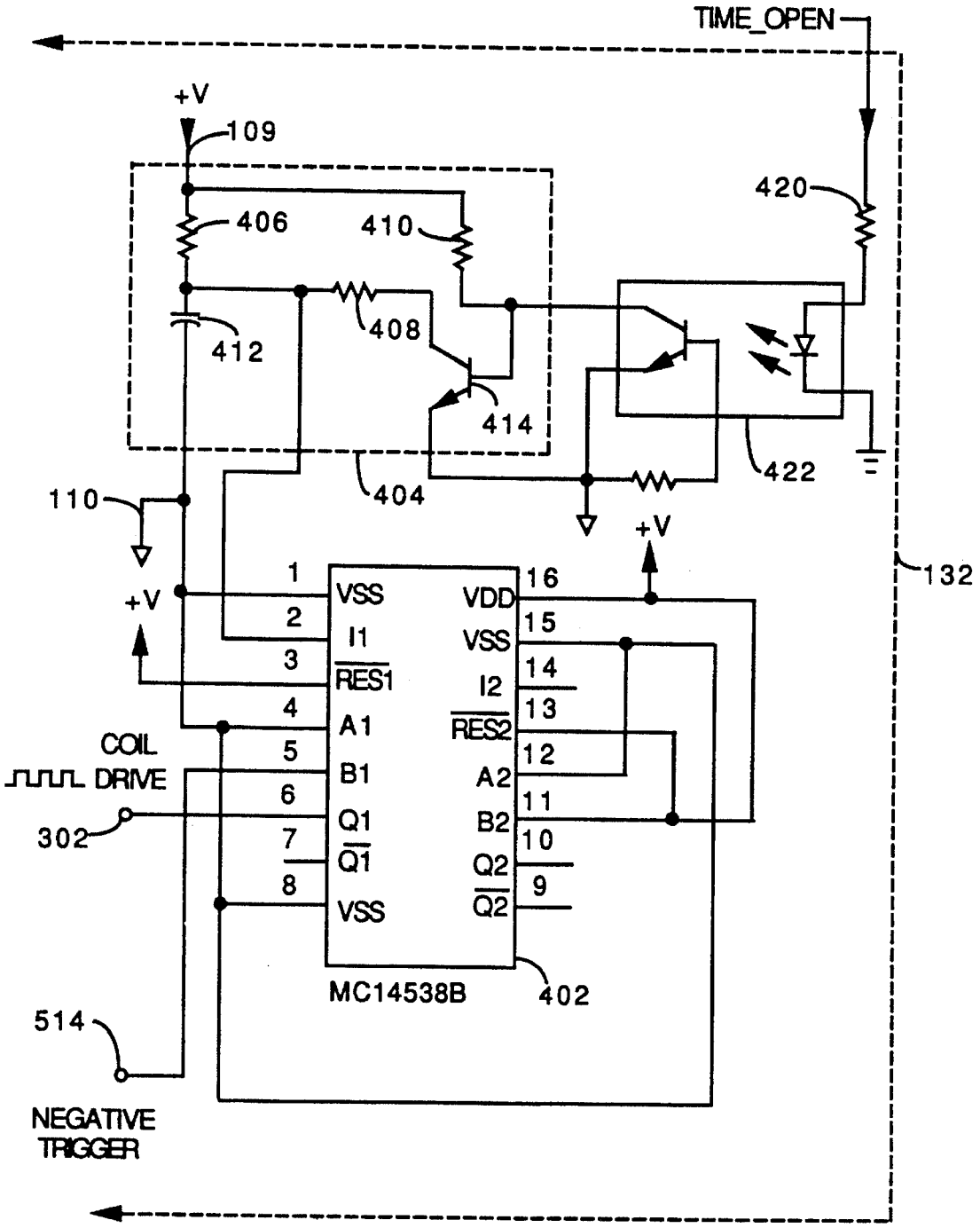
FIG. 4B PRIOR ART
FIG. 4B is a schematic diagram of a circuit used to generate switching signals for the contactor coil switching arrangement of FIGS. 2B and 4A.

Referring now to FIGS. 4A and 4B, the contactor coil conduction control circuit 130 and the contactor coil drive circuit 132 are shown in schematic form. Contactor coil SC is driven with a pulse-width modulated drive signal coupled to terminal 302. The pulse-width modulated drive signal is generated by monostable multivibrator 402, which is discussed in greater detail below, and drives complementary transistors 304,306 which are coupled in a push-pull configuration. Transistor 304, a p-channel FET, and transistor 306, an n-channel FET, have their respective gates coupled together. The respective source and drain terminals of transistors 304,306 are coupled via resistor 308. The drain terminal of transistor 306 is the output terminal 312 of the push-pull pair 304,306. A power supply 314 generates+V DC power from the+VDC voltage between terminals 108, 110. The +V DC power and ground connections for transistors 304,306 are provided through terminals 109 and 110, respectively.

In the power supply 314, the anode of a zener diode MCR5 is connected to DC ground terminal 110. The parallel combination of resistors MR23A,MR23B is connected between+VDC power terminal 108 and the cathode of zener diode MCR5. The cathode of zener diode MCR5 is connected to the gate of transistor MQ3 and provides a reference voltage thereto. The cathode of a zener diode MCR6 is connected to the gate of transistor MQ3 and the anode of the zener diode MCR6 is connected to the source of transistor MQ3. A resistor MR25 is connected in parallel with the zener diode MCR6. The parallel combination of the resistor MR25 and the zener diode MCR6 protect the gate of transistor MQ3 from an excessive gate-source voltage. The drain of the transistor MQ3 is connected to a resistor MR24 which is connected to the +VDC power terminal 108. The source of the transistor MQ3 is connected to the anode of a diode MCR7. The cathode of the diode MCR7 is connected to the+V power terminal 109. A capacitor MC6 is interconnected between the+V power terminal 109 and the DC ground terminal 110. The voltage+V at terminal 109 is determined by the discharge characteristic of capacitor MC6 which discharges through the remainder of the circuit connected to the terminal 109.

When the voltage of the+VDC power terminal 108 is greater than the voltage of the+V power terminal 109, transistor MQ3 operates in the linear region and sources current through diode MCR7 to charge capacitor MC6. When the pulsating DC voltage of the+VDC power terminal 108 is less than the voltage of the +V power terminal 109, transistor MQ3 turns off. This occurs near the zero crossing of the line voltage "E" of FIG. 2B. The diode MCR7 prevents the discharge of the capacitor MC6 through the transistor MQ3. In this manner, the power supply 314 converts a generally pulsating DC voltage formed by the output of the full-wave bridge CCR10–CCR13 of FIG. 2B at+VDC power terminal 108 to a generally DC voltage at+V power terminal 109.

In the configuration shown in FIG. 4A, whenever the pulse-width modulated signal coupled to terminal 302 is driven low, transistor 304 is forced into conduction, thus generating an output current at terminal 312. During positive going phases of the pulse-width modulated signal, transistor 304 turns off and transistor 306 turns on, thus rapidly driving terminal 312 low. Accordingly, the signal present at terminal 312 is a phase-inverted, current amplified version of the pulse-width modulated signal coupled to terminal 302.

The signal generated at terminal 312 is coupled to the respective gate terminals of switching transistors 106*a*, 106*b* through resistors 316,318, respectively. Respective zener diodes 320,322 are coupled between the gate terminals of transistors 106*a*, 106*b* and DC ground terminal 110 to provide protection for the respective transistors in the presence of high voltage transient signals. The respective source terminals of transistors 106*a*, 106*b* are coupled to DC ground terminal 110 via feedback resistor 324. As is discussed in greater detail below, resistor 324 generates a voltage at terminal 326 which is related to the level of current flowing in contactor coil SC. The respective drain terminals of transistors 106*a*, 106*b* are coupled to reference node 325 which is further coupled to the source terminals of switching transistors 104*a*, 104*b*. Reference node 325 is coupled to DC power terminal 108 through fly-back diode 133.

The respective drain terminals of switching transistors 104*a*, 104*b* are coupled in parallel to one terminal (CJ3 terminal 2 of FIG. 2B) of contactor coil SC. The opposite end of contactor coil SC is coupled to DC power terminal 108, in order that whenever transistors 104*a*–104*b* and 106*a*–106*b* are forward biased, current flows from DC power terminal 108, through contactor coil SC, through transistors 104*a*–104*b* and 106*a*–106*b*, and through feedback resistor 324 to DC ground terminal 110. During periods when transistors 106*a*–106*b* are turned-off and transistors 104*a*–104*b* remain conductive, current circulates through contactor coil SC, switching transistors 104*a*–104*b* and fly-back diode 133. Parallel transistor pairs 104*a*–104*b* and 106*a*–106*b* are employed to increase the current handling capacity of the circuit 300. Those skilled in the art will appreciate that the pairs 104*a*–104*b* and 106*a*–106*b* may be replaced by single transistors in many applications.

Bias for transistors 104*a*–104*b* is controlled by contactor coil conduction control circuit 130 which includes NPN transistor 330 disposed with its collector coupled to DC power terminal 108 and its base coupled to DC power terminal 108 via resistor 332. Voltage reference zener diode 334 is coupled between the base of transistor 330 and reference node 325. Accordingly, resistor 332 and zener diode 334 provide a relatively stable bias network for transistor 330. The emitter of transistor 330 is coupled to the gate terminals of switching transistors 104*a*, 104*b* via diode 338 and resistors 340,342, respectively. The common junction of resistors 340, 342 and diode 338 is further coupled to a delay network 336 formed by a resistor 344 and a capacitor 346. Clamping zener diodes 348,350 are coupled between the respective gate terminals of transistors 104*a*, 104*b* and reference node 325.

In operation, the circuit 300 is activated by the presence of the pulse-width modulated switching signal coupled to terminal 302. During negative transitions of the pulse-width modulated signal, transistor 304 conducts, thus injecting current into the gate terminals of transistors 106*a*–106*b* causing the transistors 106*a*–106*b* to conduct. When transistors 106*a*–106*b* turn-on, reference node 325 and the source terminals of transistors 104*a*–104*b* are coupled to ground through transistors 106*a*–106*b*. In this state, as discussed in greater detail below, whenever capacitor 346 is charged, transistors 104*a*–104*b* begin to conduct and a closing current, or a holding current, is induced in contactor coil SC.

Bias for transistors 104a–104b is generated by transistor 330 which generates a relatively constant current whenever reference node 325 is driven low by transistors 106a–106b. In other words, when reference node 325 is driven low by transistors 106a–106b, current flows from the emitter of transistor 330, through diode 338 and delay network 336, to reference node 325. This action generates a positive voltage at the gate terminals of transistors 104a–104b which is sufficient to bias and turn-on these transistors. Furthermore, whenever transistor 330 conducts, capacitor 346 charges to a voltage approximately equal to the voltage of the zener reference 334.

Whenever the pulse-width modulated signal is present at terminal 302, transistors 106a–106b are rapidly switched between conductive and non-conductive states at a frequency of the pulse-width modulated signal. However, because of the relatively long time constant of delay network 336 with respect to the pulse-width modulated signal, transistors 104a–104b remain conductive during both positive and negative cycles of the pulse-width modulated signal. Therefore, during non-conductive states of transistors 106a–106b, while transistors 104a–104b remain conductive, current circulates through contactor coil SC and transistors 104a–104b via fly-back diode 133. However, once the pulse-width modulated signal is terminated, capacitor 346 is discharged by resistor 344. Once the voltage across capacitor 346 falls below the switching threshold of transistors 104a–104b, transistors 104a–104b turn-off, thus interrupting the current circulating between contactor coil SC and fly-back diode 133. In the exemplary embodiment, capacitor 346 is discharged to the switching threshold of transistors 104a–104b in approximately 9 ms. Once current flow through contactor coil SC is interrupted, contactor coil flux rapidly collapses and the contactor immediately opens.

Figure 4C:
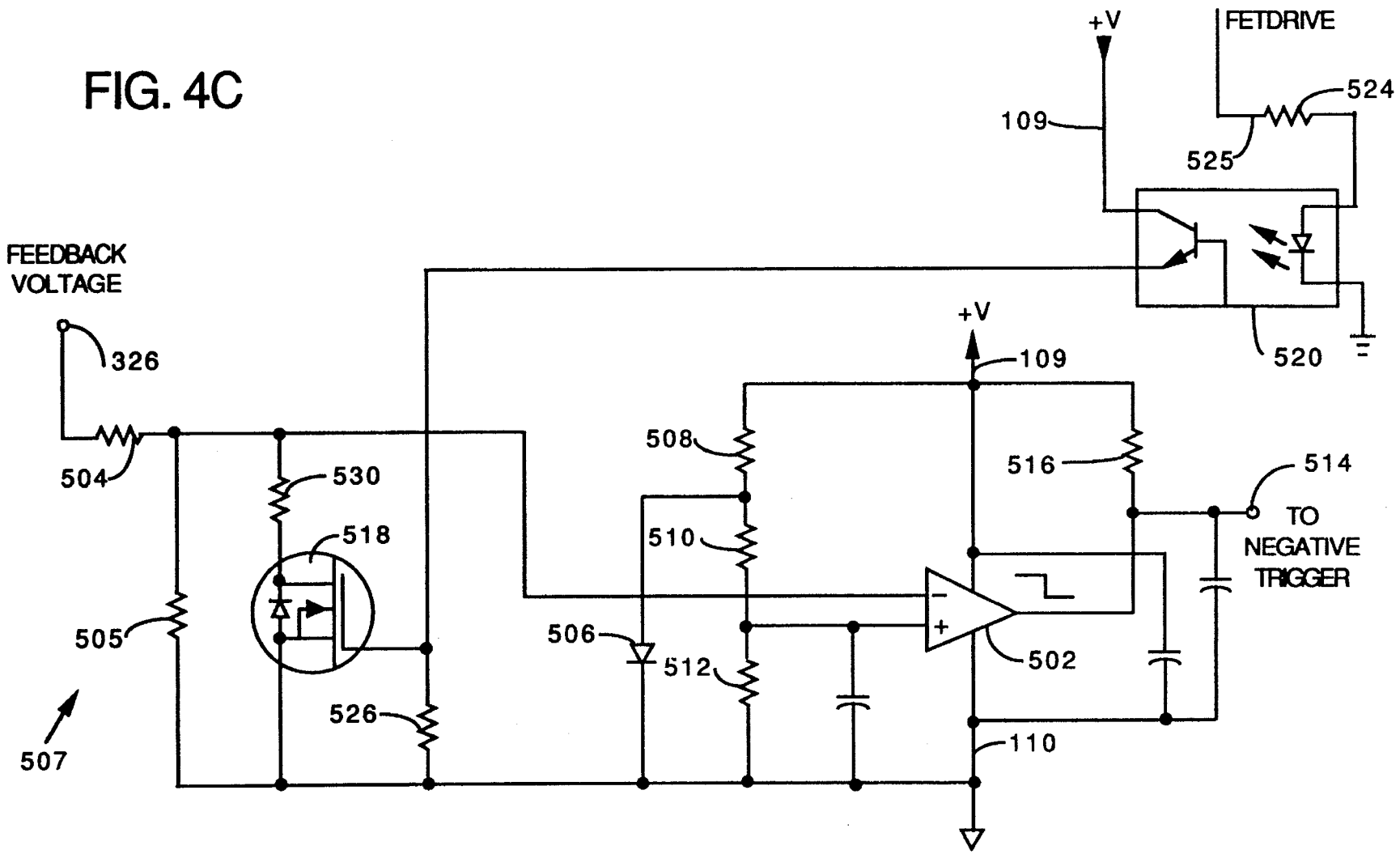
FIG. 4C is a schematic diagram of a feedback circuit used to regulate current flow in the contactor coil of FIGS. 2B and 4A.

Referring now to FIGS. 4B and 4C, the pulse-width modulated signal coupled to terminal 302 is generated by multivibrator 402 which is triggered by duty cycle generator 404 formed by resistor 406 and capacitor 412. In operation, capacitor 412 is continuously charged via resistor 406 which is coupled between+V power terminal 109 and capacitor 412. When the voltage across capacitor 412 reaches a predetermined threshold, the output of multivibrator 402 is triggered to change state and begin the next contactor coil conduction cycle.

As coil current builds in contactor coil SC, a feedback voltage is developed across resistor 324 (see FIG. 4A) at terminal 326. The feedback voltage appearing at terminal 326 is coupled to the inverting input of comparator 502 through a divider 507 comprising resistors 504,505. The non-inverting input of comparator 502 is coupled to a voltage reference formed by diode 506 and resistors 508,510 and 512, wherein resistors 508, 510 and 512 are coupled in series between+V power terminal 109 and DC ground terminal 110 to form a voltage divider, and further wherein diode 506 provides a relatively fixed voltage across resistors 510 and 512. Therefore, a relatively stable reference voltage is generated at the junction of resistors 510, 512 to provide a fixed reference voltage for comparator 502. Accordingly, whenever the feedback voltage generated across resistor 505 exceeds the reference voltage of comparator 502, the output of comparator 502 is driven low.

The output of comparator 502 is coupled to terminal 514 which is further coupled to+V power terminal 109 through pull-up resistor 516. Thus, the voltage appearing at terminal 514 is either pulled high by resistor 516 or is driven low by comparator 502 whenever the feedback voltage appearing across resistor 505 exceeds the reference voltage of comparator 502.

Terminal 514 is further coupled to the negative trigger input of multivibrator 402. In other words, whenever terminal 514 is pulled low by comparator 502, the output of multivibrator 402 changes state to high. Therefore, a contactor coil conduction cycle is initiated by timing capacitor 412 reaching a predetermined threshold, and is terminated by the feedback voltage across resistor 505 triggering comparator 502.

The continuous operation of multivibrator 402 is enabled by the TIME_OPEN signal which is coupled to resistor 420. The TIME_OPEN signal controls timing transistor 414 through opto-isolator 422. Whenever TIME_OPEN is low or inactive, the output of opto-isolator 422 is pulled high by pull-up resistor 410, thus biasing timing transistor 414 on and clamping the voltage of timing capacitor 412, through resistor 408, at a level well below the trigger threshold of multivibrator 402. Whenever TIME_OPEN is low, the operation of multivibrator 402 is inhibited and the pulse-width modulated signal coupled to terminal 302 is set to high. Otherwise, when TIME_OPEN is active or high, the output of opto-isolator 422 is driven low, timing transistor 414 is turned-off and capacitor 412 charges normally, in order that the continuous operation of multivibrator 402 is enabled.

Continuing to refer to FIG. 4C, transistor 518 is controlled by the signal FETDRIVE which is coupled to terminal 525 and controls opto-isolator 520. Whenever FETDRIVE is low or inactive, resistor 526 holds the gate terminal of transistor 518 low, thus turning transistor 518 off. This allows the feedback voltage across resistor 505 to be directly presented to the negative input of comparator 502 without the attenuating influence of resistor 530. Thus, the reference voltage at the positive input of comparator 502 acts as a (smaller) holding current reference.

Whenever FETDRIVE is active or high, opto-isolator 520 is activated through resistor 524. Once opto-isolator 520 is activated, a voltage is developed across resistor 526, thus turning on transistor 518. When transistor 518 turns on, the feedback voltage across resistor 505 is reduced by resistor 530 which is effectively connected in parallel with resistor 505 by transistor 518. This action reduces the feedback signal to the negative input of comparator 502. Hence, the reference voltage at the positive input is more significant and, thus, acts as a (larger) closing current reference. Those skilled in the art will appreciate that reducing the feedback voltage is equivalent to increasing the reference voltage. Accordingly, both holding and closing contactor coil reference signals are readily achieved by selective control of the FETDRIVE signal.

Referring now to FIGS. 2A–2C and 5, FIG. 5 is a flow chart of a firmware routine executed by microprocessor CU1 in order to generate the current reference signal. At step 360, microprocessor CU1 determines whether start signal "3" is active at input port CP2. If not, step 360 is repeated. On the other hand, if the start signal "3" is active then, at step 362, microprocessor CU1 determines whether the permit signal "P" is active at input port CP1. If not, step 360 is repeated. Otherwise, at step 364, after determining that both the start "3" and the permit "P" signals are active, microprocessor CU1 outputs a closing current reference by setting the signals FETDRIVE and TIME OPEN true (see FIGS. 4B–4C). At step 365, after the beginning of the closing cycle, microprocessor CU1 determines whether sufficient VA are available for closure by reading the signal COIL I SENSE at input MUX 4 and saving the maximum coil current. At step 366, a check of whether a half cycle of the line voltage signal "E" at input CP0 of microprocessor CU1 has elapsed. If not, the microprocessor CU1 repeats step 365. Otherwise, after the half cycle of "E" has elapsed, at step 367, if the maximum coil current is not greater than a predetermined minimum closing current value, then microprocessor CU1 disables the current reference by setting the signals FETDRIVE and TIME_OPEN false (see FIGS. 4B–4C) at step 371 before the routine re-executes step 360. Otherwise, at step 368, microprocessor CU1 delays before outputting a holding current reference. This time delay, which allows the armature 42 (see FIG. 1) to seal, is predetermined from empirical data as discussed above with FIG. 3. In the exemplary embodiment, the microprocessor CU1 maintains the closing current reference for 75.0 ms before outputting the holding current reference. After the time delay, at step 369, microprocessor CU1 outputs the holding current reference by setting the signal FETDRIVE false (see FIG. 4C). In this manner, microprocessor CU1 timely outputs the closing and holding current references in order to close and seal magnet 36 (see FIG. 1) and armature 42. Next, at step 370, microprocessor CU1 determines whether the permit "P" signal is still active. If so, then step 370 is repeated. On the other hand, if the "P" signal is not active, then microprocessor CU1 cancels the pulse-width modulated switching signal by setting the signal TIME_OPEN false (see FIG. 4B) at step, thereby opening magnet 36 and armature 42. Then, step 360 is repeated in order to continue execution of the routine.

In the exemplary embodiment, as shown in Table I below, microprocessor CU1 may generate the current reference signal with a constant first value in order to close separable contacts 22,46 and 26,48. The time to seal the contacts is predetermined from empirical data as discussed above with FIG. 3. After delaying for the time required to seal the contacts, the microprocessor may generate a new current reference signal with a constant second value in order to hold separable contacts 22,46 and 26,48 closed.

TABLE I

| TIME (ms) | CURRENT REFERENCE (A) |
|---|---|
| 0.0 | 0.0 |
| +0.0 | 12.0 |
| +75.0 | 1.0 |

Table II illustrates test results, for the exemplary embodiment of FIGS. 1, 2A–2C and 4A–4C, for variations in power line E voltage and frequency, and includes a substantially constant armature closing velocity at closure, consistent armature closing times and a substantially reduced contact bounce time of 2 ms.

TABLE II

| VOLTAGE (VAC) | FREQUENCY (Hz) | CLOSING VELOCITY (inches/s) | CLOSING TIME (ms) | BOUNCE TIME (ms) |
|---|---|---|---|---|
| 80 | 60 | 27.5 | 52 | 2 |
| 120 | 50 | 28.0 | 47 | 2 |
| 120 | 60 | 30.0 | 44 | 2 |
| 120 | 70 | 28.5 | 47 | 2 |
| 130 | 60 | 29.5 | 45 | 2 |

Figure 6:
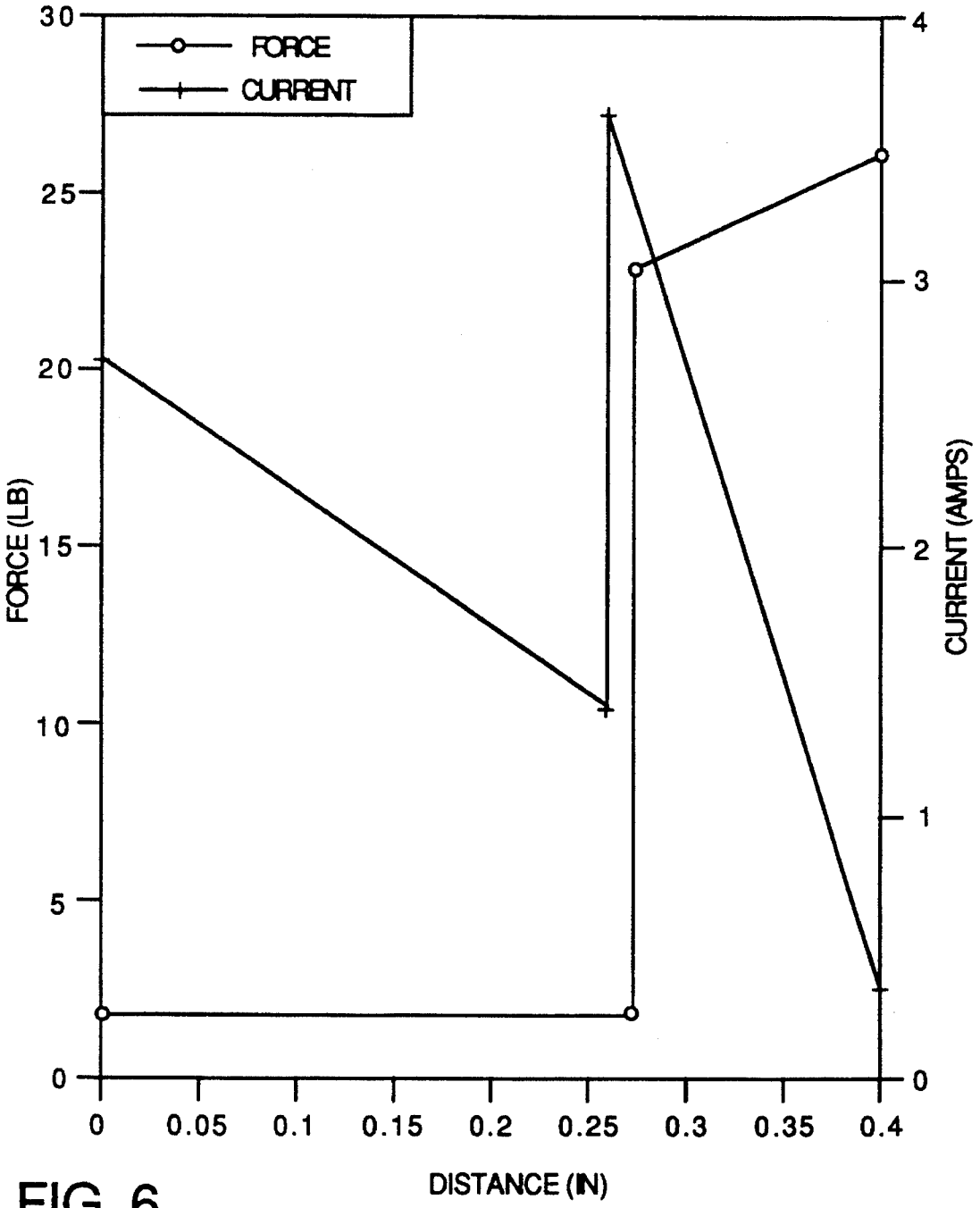
FIG. 6 is a magnet pull curve illustrating coil current regulation in accordance with the alternative embodiment of FIG. 4D.

FIG. 6 illustrates a magnet pull curve associated with current regulated closing of an alternative embodiment of the invention for contactor 10 of FIG. 1. The force required to close an electromagnetic device (e.g., magnet 36 having coil SC) is proportional to ampere-turns in the coil of the device. Thus, knowing the number of turns in the coil, coil current can be regulated to closely follow a predetermined closing force versus time characteristic, determined from empirical dam, in order to close the electromagnetic device. FIG. 6 plots travel distance of armature 42 in the horizontal axis versus force and coil current in the vertical axis. An initial high starting value for the coil current is necessary to overcome friction and the inertia of the mechanical system of contactor 10. As armature 42 closes, coil current decreases in order to limit the armature velocity whenever contacts 22,46 and 26,48 first touch. Then, the coil current is increased, thereby preventing the contacts from reopening. Thus, the armature 42 does not stall at the touch point but continues through with sufficient velocity to ensure a magnet-armature seal position without undue shock and contact bounce. After magnet 36 is closed, the coil current is progressively reduced to a holding value, because the magnet-armature gap is small in the seal position, and is held constant at the holding value in order to maintain the closed position of armature 42.

The exemplary magnet pull curve of FIG. 6 has an initial closing current at a start of the contact closure cycle. This current decreases generally linearly to a smaller intermediate closing current. Then, before closure of the separable contacts, the current increases to a final closing current which is larger than the initial closing current. Thereafter, the current decreases generally linearly to a holding current which is smaller than the intermediate closing current.

Figure 4D:
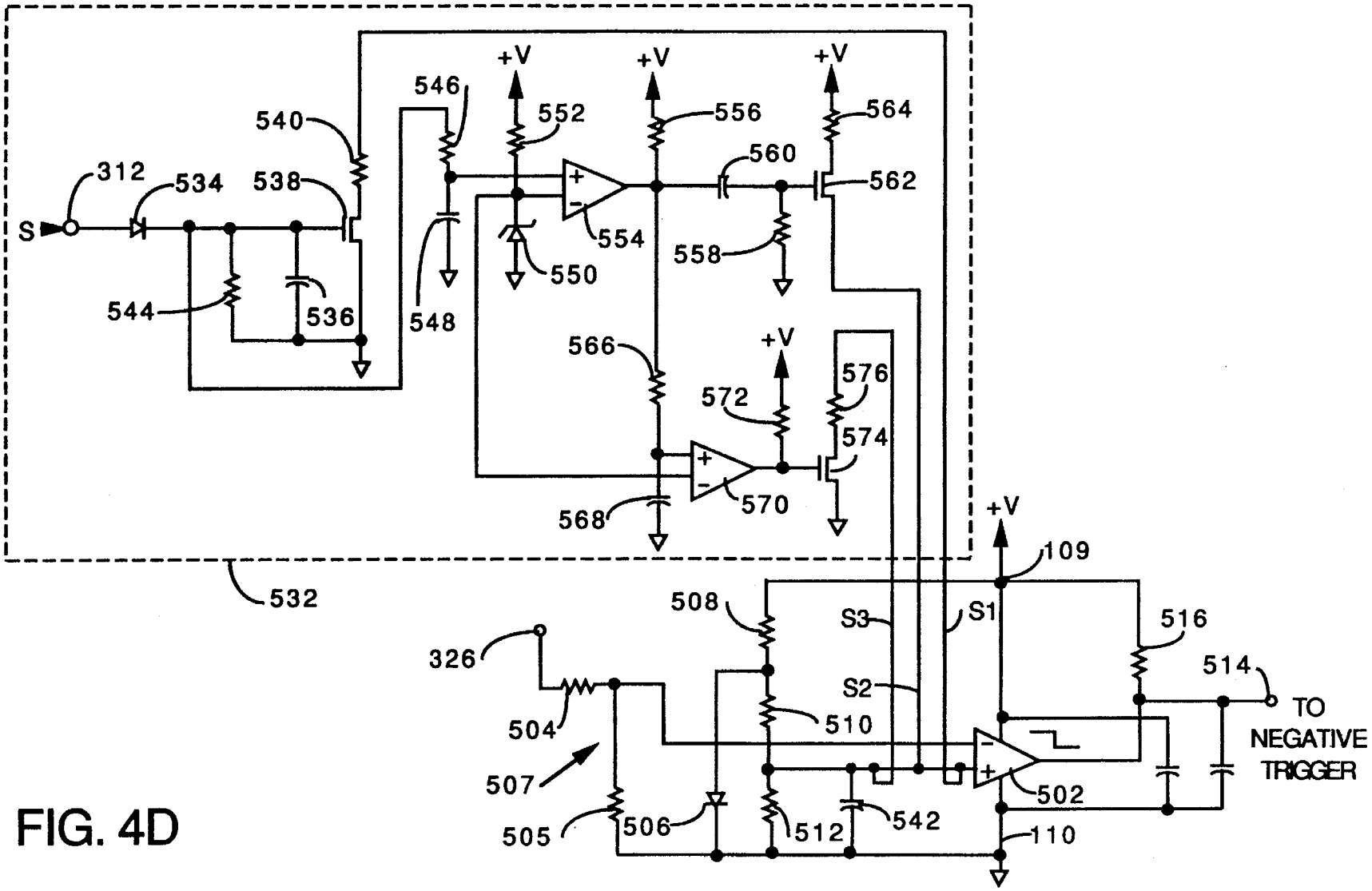
FIG. 4D is a schematic diagram of a feedback circuit used to regulate current flow in the contactor coil of FIGS. 2B and 4A in accordance with an alternative embodiment of the invention.
Figure 5:
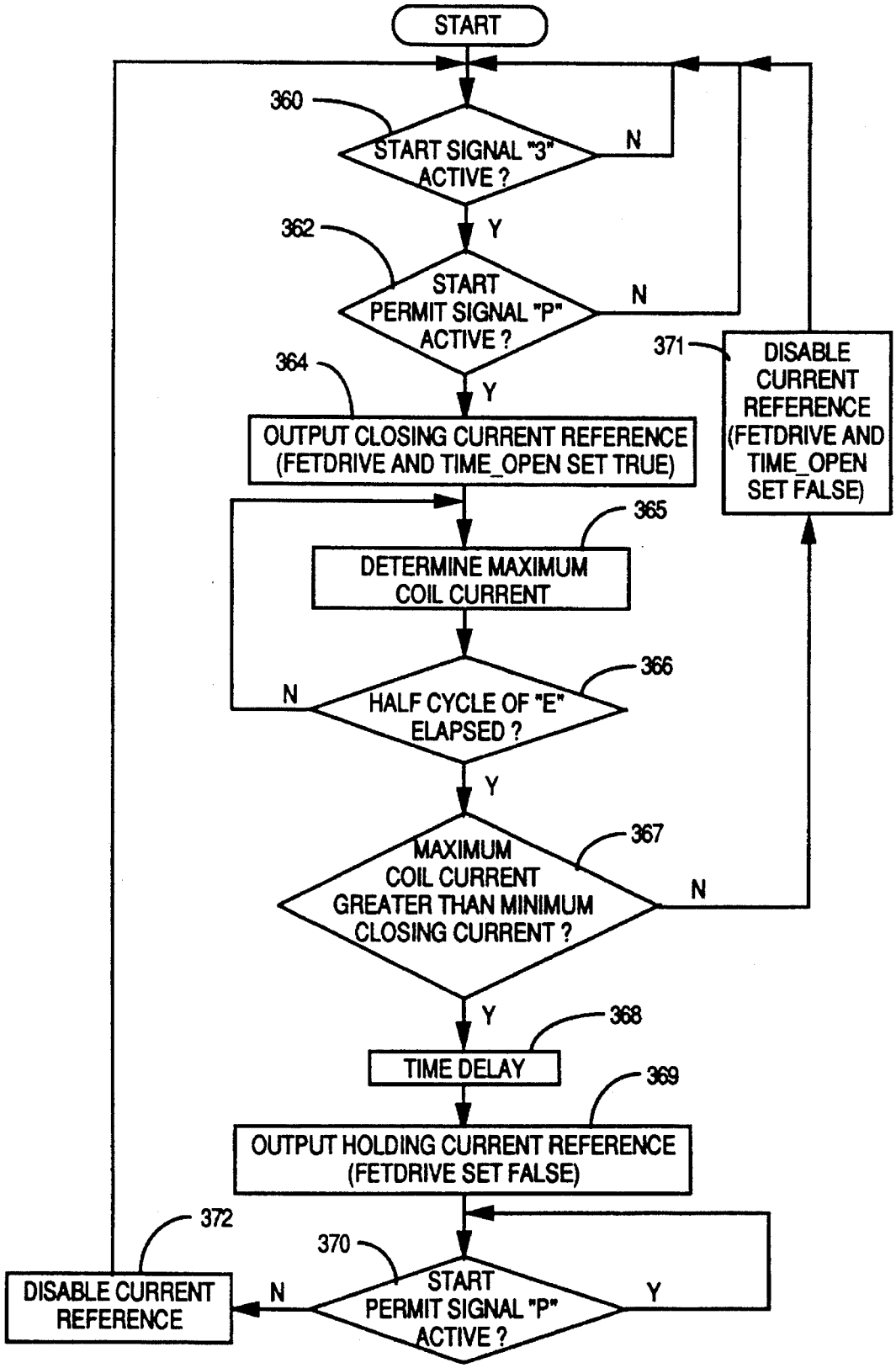
FIG. 5 is a flow chart of a microcomputer firmware routine for generating current references in accordance with the embodiment of FIGS. 4A–4C.
Figure 7:
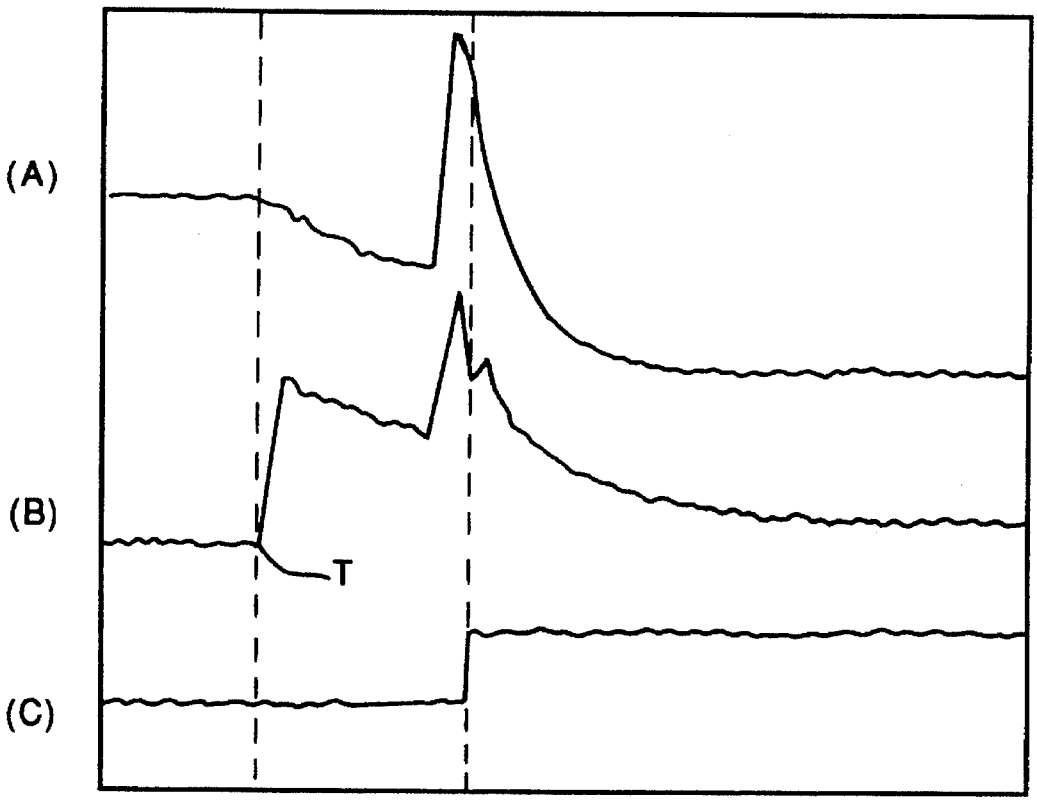
FIG. 7 illustrates a coil current reference signal, a coil current waveform and a main contact position for a contactor operated in accordance with the alternative embodiment of FIG. 4D.

In this alternative embodiment of the invention, as illustrated in FIG. 4D, a circuit 532 varies the current reference signal at the positive input of comparator 502 with respect to time. The circuit 532 provides the relationship of closing and holding force or current versus distance as illustrated by FIG. 6. As shown in Table III, below, and as illustrated by FIG. 7, graph (A), the current reference is initially maintained at a value corresponding to a current reference of 8.0 A. During the start of the contact closure cycle, the current reference decreases to 5.0 A after 32 ms. Then, the current reference rapidly increases to 13.0 A within 4 ms. Finally, the current reference decreases to a holding current value of 1.1 A within 64 ms.

TABLE III

| TIME (ms) | CURRENT REFERENCE (A) |
|---|---|
| −0.0 | 8.0 |
| +0.0 | 8.0 |
| 32.0 | 5.0 |
| 36.0 | 13.0 |
| 100.0 | 1.1 |

As shown in FIG. 7, graph (B), after the contact closure cycle begins at time T, the coil current in coil SC of FIG. 1 is rapidly regulated from zero amperes to the initial closing current value of 8 A. Thereafter, the coil current closely follows the current reference signal of FIG. 7, graph (A). Whenever contactor 10 of FIG. 1 closes contacts 22,46 and 26,48, as shown in FIG. 7, graph (C), the armature closing velocity at closure is near zero. As shown in FIG. 7, graphs (B) and (C), the increased coil current, prior to closure, ensures that the armature 42 assumes the magnet-armature seal position with negligible contact bounce. In this manner, contact bounce time is reduced from a prior art time of 6 ms to approximately 0 ms. After the unit is closed, the coil current is reduced to a holding current reference of approximately 1.1 A.

Referring again to FIG. 4D, the circuit 532 receives a start signal S from terminal 312 of FIG. 4A. The circuit 532 generates a sequence of three timing signals S1,S2,S3 in order to vary the current reference signal as discussed above with FIG. 7, graph (A). At the start of the contact closure cycle, the start signal S is driven to a positive voltage approximately equal to+V in response to the TIME_OPEN signal of FIG. 4B. This contact closure cycle has three distinct phases which correspond to the timing signals S1,S2,S3. Current from the start signal S flows through diode 534 and charges capacitor 536 which is connected between the gate and source of transistor 538. The resulting voltage at capacitor 536 turns transistor 538 on. Thus, resistor 540, which is connected between the drain of transistor 538 and the positive input of comparator 502, is effectively connected in parallel with resistor 512 and capacitor 542. Then, the voltage across capacitor 542, which is the coil current reference signal, decays with the time constant of parallel resistors 512,540 and capacitor 542, as discussed above with FIG. 7, graph (A), and Table III.

Diode 534 prevents the discharge of capacitor 536 during the entire contact closure cycle. Whenever the TIME_OPEN signal of FIG. 4B switches inactive (and the separable contacts are opened), resistor 544 discharges capacitor 536 and, thus, turns off transistor 538. The initial coil closing current reference voltage is determined by diode 506 and a divider formed by resistor 510 and resistor 512.

The second phase of the contact closure cycle is provided by signal S2. In response to the voltage across the capacitor 536, resistor 546 charges capacitor 548. A reference voltage is provided by a zener diode 550 which is connected to the+V power terminal 109 through resistor 552. An open-collector output comparator 554 has a positive input connected to the capacitor 548 and a negative input connected to the zener diode 550. Whenever the voltage of the capacitor 548 exceeds the reference voltage of the zener diode 550, the open-collector output of a comparator 554 switches from a normally low on-state to an off-state.

The open-collector output of the comparator 554 is directly pulled-up to the+V power terminal 109 through resistor 556 and is AC-coupled to a pull-down resistor 558 through capacitor 560. The resistor 558 is connected between the gate and source of a transistor 562. Whenever the comparator 554 switches to the off-state, the gate voltage of the transistor 562 is established by a divider formed by resistors 556,558 between the+V power terminal 109 and the DC ground terminal 110. Then, as the capacitor 560 is charged, the gate voltage of the transistor 562 decays with the time constant of the effectively parallel resistors 556,558 and the capacitor 560. In this manner, transistor 562 turns on for a period of time corresponding to such time constant. In turn, whenever transistor 562 turns on, resistor 564, which is connected between the drain of transistor 562 and+V power terminal 109, is effectively connected in parallel with the series combination of resistors 508,510. Then, the coil current reference voltage signal across capacitor 542 increases, as discussed above with FIG. 7, graph (A), and Table III, in order to provide an increased coil current reference just prior to the closing of the separable contacts. Later, as the capacitor 560 charges and the gate voltage of the transistor 562 decreases, the transistor 562 turns off and disables the flow of current at signal S2. Diode 534 also prevents the discharge of capacitor 548 during the entire contact closure cycle. Whenever the TIME_OPEN signal switches inactive, the series combination of resistors 544, 546 discharge capacitor 548 and, hence, return the comparator 554 to its normally low output state.

Signal S3 provides the third phase of the contact closure cycle. In response to the positive output voltage of the comparator 554, resistor 566 charges capacitor 568. An open-collector output comparator 570 has a positive input connected to the capacitor 568 and a negative input connected to the zener diode 550. Whenever the voltage of the capacitor 568 exceeds the reference voltage of the zener diode 550, the open-collector output of a comparator 570 switches from a normally low on-state to an off-state. The open-collector output of the comparator 570 is directly pulled-up to the+V power terminal 109 through resistor 572. The output of the comparator 570 is also connected to the gate of a transistor 574. Whenever the transistor 574 turns on, a resistor 576, which is connected between the drain of transistor 574 and the positive input of the comparator 502, is effectively connected in parallel with resistor 512, capacitor 542, and the series combination of transistor 538 and resistor 540.

The time constant of resistor 566 and capacitor 568 delay the start of the S3 signal until after the closure of the separable contacts. In response to the voltage of capacitor 568, the open-collector output of the comparator 570 turns off and is pulled-up by resistor 572. Then, transistor 574 turns on in order to increase the discharge rate of capacitor 542. In this manner, as discussed above with FIG. 7, graph (A), and Table III, the coil current reference voltage signal across capacitor 542 decays with the time constant of parallel resistors 512,540,576 and capacitor 542. The final coil holding current reference voltage is determined by diode 506 and a divider formed by resistor 510 and resistors 512,540,576.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. An electromagnetic switch comprising:

separable contacts;

electromagnetic means having a coil which is energized during a contact closure cycle to close said separable contacts and to hold said separable contacts closed, and which is deenergized to open said separable contacts;

power supply means for applying current to energize said coil; and control means for sensing said current applied to said coil and regulating, throughout said contact closure cycle, said current applied to said coil, said control means including means regulating a closing current to a plurality of different closing current references during a period of time about as long as required for said separable contacts to seal closed and a holding current to a holding current reference for holding said separable contacts closed.

2. The electromagnetic switch as recited in claim 1, wherein said control means comprises a microcomputer for generating said current references.

3. The electromagnetic switch as recited in claim 1, wherein said control means further comprises:

first switching means, responsive to a first control signal, for selectively enabling or inhibiting current flow through said coil from said power supply means;

second switching means, responsive to a second control signal, for selectively conducting current flow from said first switching means;

first control means for selectively generating said second control signal, wherein said second control signal comprises a square wave switching signal for actuating said second switching means between conductive and non-conductive states; and second control means for generating said first control signal, wherein said first control signal comprises a switching signal for actuating said first switching means between enabled and inhibited states, and further wherein said first switching means is switched to said enabled state whenever said square wave switching signal is generated and is switched to said inhibited state whenever said square wave switching signal is not generated.

4. The electromagnetic switch as recited in claim 3, wherein said square wave switching signal comprises a pulse-width modulated signal having a variable duty cycle and wherein said first control means is responsive to a feedback signal for varying said variable duty cycle of said pulse-width modulated signal in response thereto.

5. The electromagnetic switch as recited in claim 4, wherein said first control means further comprises feedback means for sensing a level of current flowing through said second switching means from said first switching means, and for generating said feedback signal in relation thereto.

6. The electromagnetic switch as recited in claim 5, wherein said first control means includes means responding to a first input signal for selectively enabling the generation of said square wave switching signal and means responding to a second input signal for forcing said pulse-width modulated signal between states corresponding to said closing current references and said holding current reference.

7. The electromagnetic switch as recited in claim 6, wherein said control means further includes a microcomputer which generates said first and said second input signals in order to generate said closing current references and said holding current reference.

8. The electromagnetic switch as recited in claim 6, wherein said means responding to said second input signal attenuates said feedback signal in response to said second input signal, in order to provide said closing current references.

9. The electromagnetic switch as recited in claim 6, wherein said means responding to said second input signal passes said feedback signal unattenuated in response to said second input signal, in order to provide said holding current reference.

10. The electromagnetic switch as recited in claim 5, wherein said feedback means includes comparator means for comparing a predetermined reference signal and said feedback signal, and for resetting said square wave switching signal to an inhibiting state whenever said feedback signal is greater than said predetermined reference signal.

11. The electromagnetic switch as recited in claim 3, wherein said second control means further comprises flyback diode means for selectively conducting current from said first switching means to said power supply means when said first switching means is enabled and said second switching means is non-conductive.

12. The electromagnetic switch as recited in claim 1, wherein said means regulating a closing current includes means providing an initial closing current at a start of said contact closure cycle, means providing an intermediate closing current which is smaller than said initial closing current, means providing progressively smaller currents between said initial closing current and said intermediate closing current, means providing a final closing current which is larger than said initial closing current, and means providing progressively smaller currents between said final closing current and said holding current.

13. An electromagnetic switch comprising:

separable contacts;

electromagnetic means having a coil which is energized during a contact closure cycle to close said separable contacts and to hold said separable contacts closed, and which is deenergized to open said separable contacts, said electromagnetic means also having a predetermined magnet pull curve with a step change therein;

power supply means for applying current to energize said coil; and control means for sensing said current applied to said coil and regulating, throughout said contact closure cycle, said current applied to said coil to a time-variable current reference to close said separable contacts and to hold said separable contacts closed, said control means including means for generating said time-variable current reference which substantially follows the step change of the predetermined magnet pull curve.

14. The electromagnetic switch as recited in claim 13, wherein said current includes an initial closing current at a start of said contact closure cycle; an intermediate closing current which is smaller than said initial closing current; progressively smaller currents between said initial closing current and said intermediate closing current; a final closing current which is larger than said initial closing current; a holding current which is smaller than said intermediate closing current; and progressively smaller currents between said final closing current and said holding current.

15. The electromagnetic switch as recited in claim 14, wherein said means for generating said time-variable current reference which substantially follows the step change of the predetermined magnet pull curve includes means for generating said time-variable current reference which corresponds to said initial closing current, means for generating said progressively smaller currents between said initial closing current and said intermediate closing current, means for generating said final closing current, and means for generating said progressively smaller currents between said final closing current and said holding current, said final closing current being generated at about a time of closing said separable contacts.

16. An improved control system for use with an electromagnetic contactor having a coil for actuating said electromagnetic contactor, separable contacts actuated by said coil, and a close input for closing said separable contacts in a contact closure cycle, said control system comprising:

closed-loop control means for sensing current applied to said coil and regulating, throughout said contact closure cycle, said current applied to said coil whenever said close input is active, said control means further for inhibiting said current applied to said coil whenever said close input is inactive, said control means including means regulating a closing current to a plurality of different closing current references during a period of time about as long as required for said separable contacts to seal closed and a holding current to a holding current reference for holding said separable contacts closed.

17. The improved control system as recited in claim 16, wherein said closed-loop control means comprises:

first switching means, responsive to a first control signal, for selectively enabling or inhibiting current flow through said coil from a source of power;

second switching means, responsive to a second control signal, for selectively conducting current flow from said first switching means;

first control means for selectively generating said second control signal, wherein said second control signal comprises a square wave switching signal for actuating said second switching means between conductive and non-conductive states; and second control means for generating said first control signal, wherein said first control signal comprises a switching signal for actuating said first switching means between enabled and inhibited states, and further wherein said first switching means is switched to said enabled state whenever said square wave switching signal is generated and is switched to said inhibited state whenever said square wave switching signal is not generated.

18. The improved control system as recited in claim 16 wherein said coil has a predetermined magnet pull curve with a step change therein; and wherein said control means includes means for generating a time-variable current reference which substantially follows the step change of said predetermined magnet pull curve.

* * * * *